US007204485B2

(12) United States Patent
Ko et al.

(10) Patent No.: US 7,204,485 B2
(45) Date of Patent: Apr. 17, 2007

(54) MEDIA THICKNESS DETECTING DEVICE OF MEDIA DISPENSER

(75) Inventors: Kyung-Ho Ko, Gyeonggi-Do (KR); Eung-Min Park, Seoul (KR)

(73) Assignee: LG Electronics Inc., Seoul (KR)

( * ) Notice: Subject to any disclaimer, the term of this patent is extended or adjusted under 35 U.S.C. 154(b) by 540 days.

(21) Appl. No.: 10/442,275

(22) Filed: May 21, 2003

(65) Prior Publication Data

US 2004/0065996 A1 Apr. 8, 2004

(30) Foreign Application Priority Data

Oct. 7, 2002 (KR) ..... 10-2002-0061075

(51) Int. Cl.
*B65H 7/02* (2006.01)

(52) U.S. Cl. ..... 271/265.04

(58) Field of Classification Search ..... 271/258.01, 271/262, 265.04

See application file for complete search history.

(56) References Cited

U.S. PATENT DOCUMENTS 5,280,901 A * 1/1994 Smith et al. ..... 271/188
5,435,543 A * 7/1995 Lehmann ..... 271/258.04
5,577,719 A * 11/1996 Nicoll ..... 271/227
5,915,149 A * 6/1999 Anderson et al. ..... 399/124
6,000,693 A * 12/1999 Tranquilla ..... 271/263
6,247,695 B1 * 6/2001 Linder et al. ..... 271/265.04
6,385,406 B1 * 5/2002 Funamizu et al. ..... 399/16
6,969,062 B2 * 11/2005 Fasler et al. ..... 271/142
2002/0053767 A1 * 5/2002 So ..... 271/10.01

FOREIGN PATENT DOCUMENTS

CN 1350967 A 5/2002
JP 8-26528 A 1/1996
JP 02-87642 A 3/2002

* cited by examiner

*Primary Examiner*—Patrick Mackey
*Assistant Examiner*—Jeremy R Severson
(74) *Attorney, Agent, or Firm*—Ked & Associates, LLP

(57) ABSTRACT

A media thickness detecting device of a media dispenser comprises: a feed roller through which media passes to be contacted thereto, a thickness detecting portion contacted to a surface of the feed roller by a point and rotated when the media passes through the surface of the feed roller, and a thickness measuring portion measuring the thickness of the media by detecting the rotating amount of the thickness detecting portion, and thereby, the thickness of the media can be measured precisely regardless of a change of center axis angle of the feed roller.

5 Claims, 4 Drawing Sheets

MEDIA THICKNESS DETECTING DEVICE OF MEDIA DISPENSER

BACKGROUND OF THE INVENTION

1. Field of the Invention

The present invention relates to a media dispenser, and particularly, to a media thickness detecting device for a media dispenser which is able to measure the thickness of the media more precisely.

2. Description of the Background Art

FIG. 1 is a block diagram showing a general media dispenser.

The media dispenser comprises: a base plate 6 receiving a media cassette 2 where the media is stored and a collection chamber 4 for withdrawing inferior media; a media pickup portion 8 installed on a lower part of the base plate 6 for discharging the media stored in the media cassette 2 one by one; a media feeding part 10 for conveying the media discharged through the media pickup portion 8; a media discharging portion 12 for discharging the media conveyed through the media conveying portion 10 to outer part; a driving means for providing driving power required to drive the respective systems; a power transmitting means for supplying the driving power generated on the driving means to the systems; and a media withdrawing means for withdrawing inferior media during the media transmitting process.

The base plate 6 is disposed on a receiving space where the media cassette 2 is received on front side, and a receiving space where the collection chamber 4 withdrawing inferior media is received is disposed on an upper part of the above receiving space. In addition, a door 16 is mounted on front portion of the two receiving spaces.

A locking system 18 is installed on the door in order to prevent an undesignated person from accessing to the media cassette 2 and to the collection chamber 4. In addition, a cushion member 20 is installed inside the door 16 for buffing operation by adhering to a front surface of the media cassette 2.

As described above, the media cassette 2 and the collection chamber 4 are received on the front portion of the base plate 6, the door 16 is mounted on the front portion thereof to be opened/closed, and the locking system 18 is installed on the door 16 to prevent the unapproved person from accessing to the media cassette 2 and the collection chamber 4.

In addition, the cushion member 20 adhered onto the inner side surface of the door 16 absorbs the shock generated when the media is discharged from the media cassette 2.

The a power board 22 which makes the power supplied from outer part used by various electric components is mounted on a lower part of the space where the media cassette 2 is received on the base plate 6.

The driving means is a driving motor 24 which is mounted on one side of the base plate 6 for generating rotating force, and a driving pulley 26 is mounted on the driving motor 24.

The driving power transmitting means transmits the driving power generated on the driving motor 24 to respective components, the driving pulley 26 of the driving motor is connected to a passive pulley 30 by a driving belt 28 to transmit the driving power to the passive pulley 30. In addition, a timing belt 32 is wound on the passive pulley 30, a lower end connecting pulley 34 driving the media pickup portion 8 is wound on a lower end of the timing belt 32, and a discharging pulley 36 driving the media discharging portion 12 is wound on an upper end of the timing belt 32.

In addition, a plurality of tension pulleys 38 and 40 maintaining the tension of the timing belt 32 are installed on one side of the timing belt 32.

The lower end connecting pulley 34 transmits the rotating force generated by rotation of the timing belt 32 to the media pickup portion 8, and transmits the rotating force to the media conveying portion 10 as connected to the media conveying portion 10.

The media pickup portion 8 is for discharging the media stored in the media cassette 2 after dividing one by one, and comprises: a pickup roller 42 disposed on a rear portion of the media cassette 2 for discharging the media stored in the media cassette 2 downward by friction; a feed roller 44 and a dividing roller 46 disposed on a lower part of the pickup roller 42 for conveying the media discharged from the pickup roller 42 after dividing the media one by one; and a guide member 48 for guiding the media conveyed by the feed roller 44 and the dividing roller 46 toward upper direction.

The media conveying portion 10 is the portion which guides the media discharged through the media pickup portion 8 till the media discharging portion 12, and comprises a first feed belt 74 wound between a first feed roller 70 disposed on a same axis as that of the lower end connecting pulley 34 and a second feed roller 72 located on upper part; and a second feed belt 76 rotated with the first feed belt 74 as contacting to the first feed belt to convey the media.

The first feed belt 74 is wound between the first feed roller 70 which is rotated with the lower end connecting pulley 34 and the second feed roller 72 to be rotated by being transmitted the rotating force from the lower end connecting pulley 34, and guide rollers 78 and 80 guiding the moving path of the media are installed on one side of the first feed belt 74 to be rotatable.

The second feed belt 76 is rotated toward the same direction as that of the first feed belt 74 in a state that an inner side surface of the second feed belt 76 is contacted to an outer side surface of the first feed belt 74, and wound between a third feed roller 82, which is installed on a lower part of the base plate 6 to be rotatable, and a fourth feed roller 84, which is installed on a front upper part of the base plate 6 to be rotatable, and rotated.

In addition, a plurality of guide rollers 86 and 88 which guide the moving path of the second feed belt 76 are disposed on one side of the second feed belt 76.

Herein, the fourth feed roller 84 is transmitted the rotating force by gear-engaging with a gear 90 which is disposed on a same axis as that of the discharging pulley 36 on which the timing belt 32 is wound to drive the second feed belt 76.

In the above media feeding portion 10, when the driving motor 24 is operated, the timing belt 32 is rotated, and accordingly, the lower end connecting pulley 34 and the discharging pulley 36 are rotated. Then, the first feed roller 70 disposed on the same axis as that of the lower end connecting pulley 34 is rotated to rotate the first feed belt 74, and the fourth feed roller 84 gear-engaged with the discharging pulley 36 is rotated to rotate the second feed belt 76.

Then, the media discharged through the media pickup portion 8 is passes between the first feed belt 74 and the second feed belt 76, and guided to the media discharging portion 12.

The media discharging portion 12 discharges the media conveyed from the media feeding portion 10 in order to transfer the media to the user, and comprises: a first discharging roller 98 installed on a same axis as that of the discharging pulley 36 and rotated with it; and a second discharging roller 100 connected to the first discharging roller 98 through a discharging belt 102 and rotated. In addition, the discharging belt 102 is rotated toward same direction as that of the second feed belt 76 in the status of contacting to upper part of the second feed belt 76 to discharge the media to outer side.

The media withdrawing means is for withdrawing media in cassette that an error is generated or two pieces are conveyed at one time during the media is conveyed through the media feeding portion 10, and comprises a connection chamber 4 disposed on the upper part of the media cassette 2 for storing inferior media and a diverter 104 installed between the first feed belt 74 and the discharging belt 102 for withdrawing the inferior media into the collection chamber.

In addition, the media dispenser comprises: a feed sensor 92 installed on one side of the media feeding portion 10 for counting the media by sensing the media passage; a thickness detecting device 94 for detecting the thickness of the media; an eject sensor 106 for sensing the media discharged through the media discharging portion 12; a reject sensor 108 installed on the collection chamber 4 for counting the inferior media which is withdrawn; and a slit sensor 96 for sensing the rotating times of the driving motor 24 and length of the media with the feed sensor 92 to control the operations of the media dispenser.

FIG. 2 is a side view showing a media thickness detecting device of the media dispenser according to the conventional art, and FIG. 3 is a front view showing the media thickness detecting device of the media dispenser according to the conventional art. The media thickness detecting device shown in FIGS. 2 and 3 senses the overlapped media by detecting the thickness of the media, and FIGS. 2 and 3 are views showing an expanded part of the media thickness detecting device shown in FIG. 1 required by the present invention.

The media thickness detecting device according to the conventional art comprises: a feed roller 120 disposed on a same axis as that of the guide roller 80 which guides the first feed belt 74 and through which the media passes; and a thickness detecting sensor 122 surface contacted to the feed roller 120 to detect the thickness of the media 140 passing the feed roller 120 and thereby sensing the overlapped media.

The thickness detecting sensor 122 comprises: a sensing roller 124 contacted to the feed roller 120 and rotated with the feed roller 120; a rotating arm 126, to which the sensing roller 124 is mounted to be rotatable, having one side connected to a hinge shaft and rotated; and a thickness measuring portion 130 installed on the other end of the rotating arm 126 for detecting rotating times of the rotating arm 126 to measure the thickness of the media.

The sensing roller 124 is formed as a cylinder having a predetermined thickness and an outer circumferential surface of the sensing roller 124 is surface-contacted to the surface of the feed roller 120. In addition, the sensing roller 124 is mounted on an axis 132 which is connected to one side of the rotating arm 126 to be rotatable.

According to the media thickness detecting device of the conventional art, when the media passes between the feed roller 120 and the sensing roller 124, the sensing roller 124 is moved as much as the thickness of the media 140. And according to the movement of the sensing roller 124, the rotating arm 126 is rotated as centering around the hinge shaft 128 and the thickness measuring portion 130 installed on the other end of the rotating arm 126 detects the rotating amount of the rotating arm 126 to measure the thickness of the media 140.

However, in the media thickness detecting device according to the conventional art, the axis of the feed roller 120 and the axis of the sensing roller 124 should maintain the parallel status in order to detect the thickness of the media precisely. That is, the circumferential surfaces of the feed roller 120 and of the sensing roller 124 should be contacted in parallel direction with each other and maintained the ling contacting status in order to detect the precise thickness of the media. However, the angle of the axis of the feed roller 120 or of the sensing roller 124 can be changed to some degree in the assembly process or under actual usage environment due to the load, etc., and according to the change of the axis angle, the feed roller 120 and the sensing roller can not be contacted ideally. Then, the change of axis angle is deepened such that the points are contacted or edges of the rollers are contacted, or the distance is changed. Consequently, a tolerance of media thickness sensing is exceeded.

SUMMARY OF THE INVENTION

Therefore, an object of the present invention is to provide a media thickness detecting device of a media dispenser which is able to detect a thickness of media precisely regardless of a change of a feed roller center axis by making the feed roller and a media thickness detecting portion contact to each other by points.

To achieve the object of the present invention, as embodied and broadly described herein, there is provided a media thickness detecting device of a media dispenser comprising: a feed roller through which the media passes as contacting thereto; a thickness detecting portion contacted to a surface of the feed roller by a point and rotated when the media passes through a surface of the feed roller; and a thickness measuring portion for measuring the thickness of the media by detecting rotating amount of the thickness detecting portion.

The thickness detecting portion comprises: a contact portion which is contacted to the surface of the feed roller by a point; and a rotating arm having the contacting portion installed thereon and one side supported to be rotated, and rotated according to movement of the contacting portion when the media passes between the feed roller and the contacting portion.

The contacting portion is formed integrally on one end portion of the rotating arm as a hemisphere shape.

The contacting portion is a ball type which is mounted on one end portion of the rotating arm to be rotatable.

The rotating arm has one side on which the contacting portion is installed and the other side to which the thickness measuring portion is connected, and is supported by a hinge shaft to be rotatable.

The hinge shaft is located near the contacting portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a media thickness detecting device of a media dispenser according to the present invention, and hereinafter, the most preferred embodiment will be described.

Figure 5:
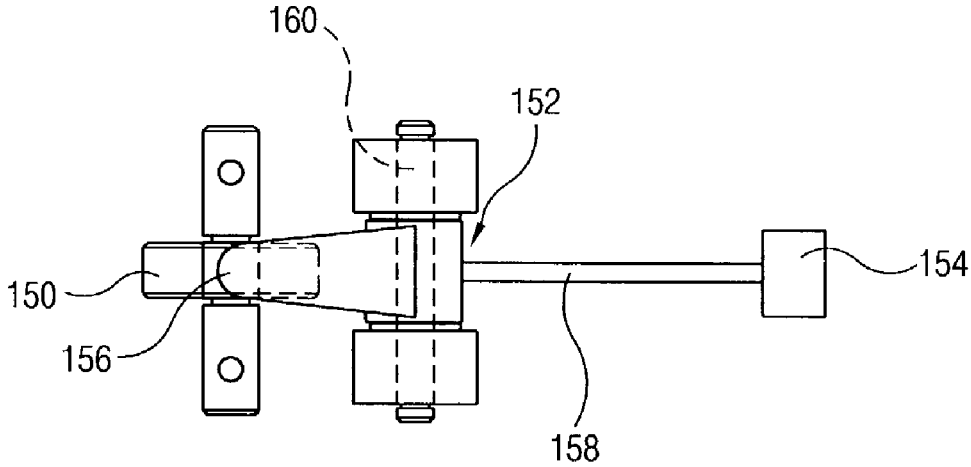
FIG. 5 is a side view showing a media thickness detecting device according to the present invention.
Figure 6:
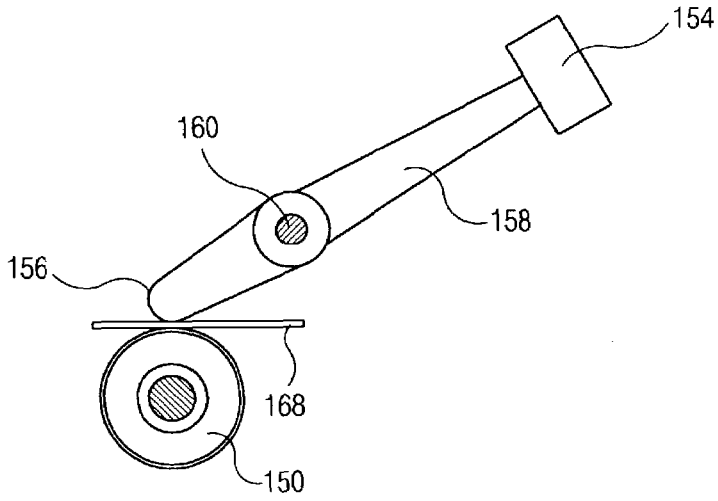
FIG. 6 is a front view showing the media thickness detecting device according to the present invention.

FIG. 5 is a front view showing the media thickness detecting device of the media dispenser according to the present invention, and FIG. 6 is a side view showing the media thickness detecting device of the media dispenser according to the present invention.

Figure 1:
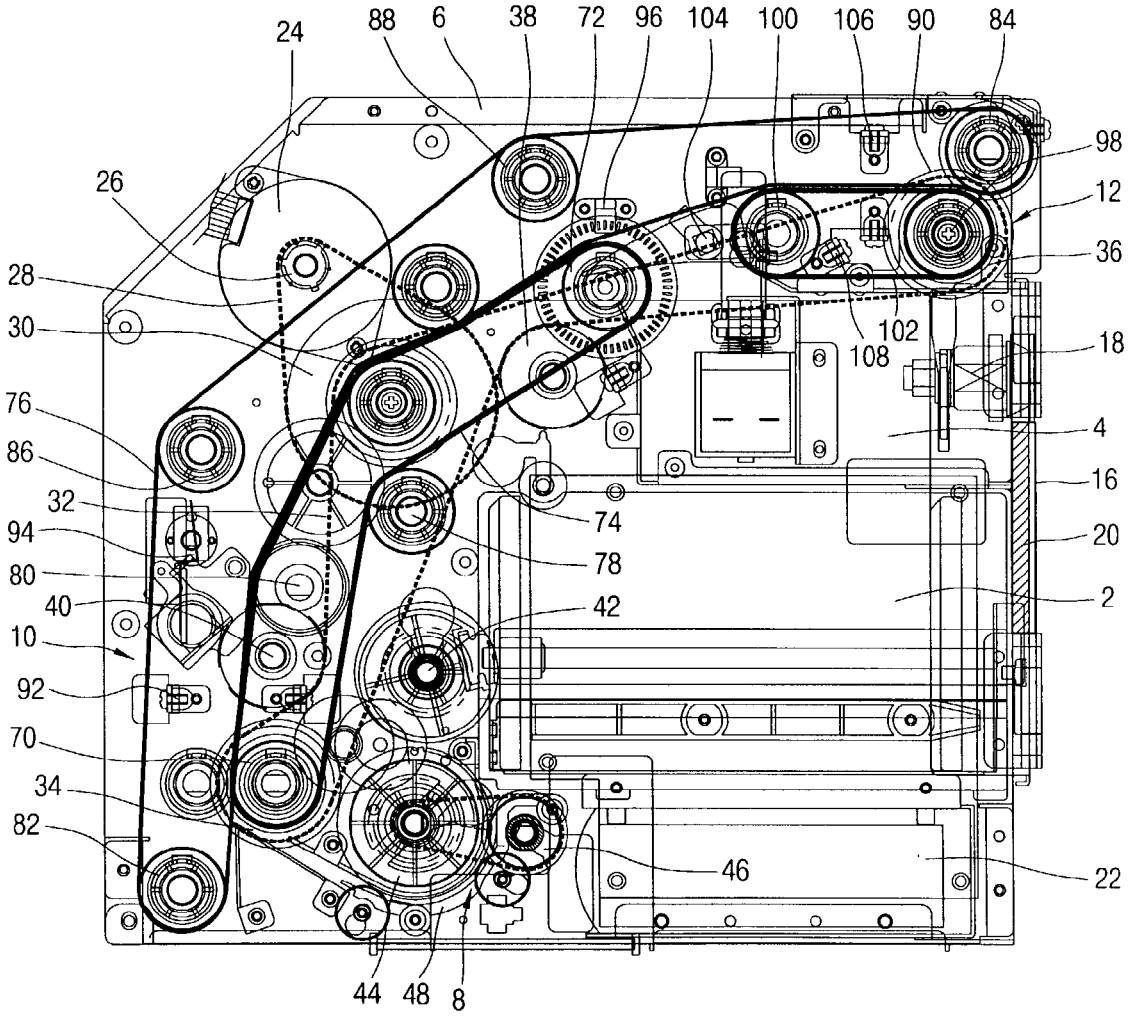
FIG. 1 CONVENTIONAL ART
FIG. 1 is a block diagram showing a general media dispenser.
Figure 2:
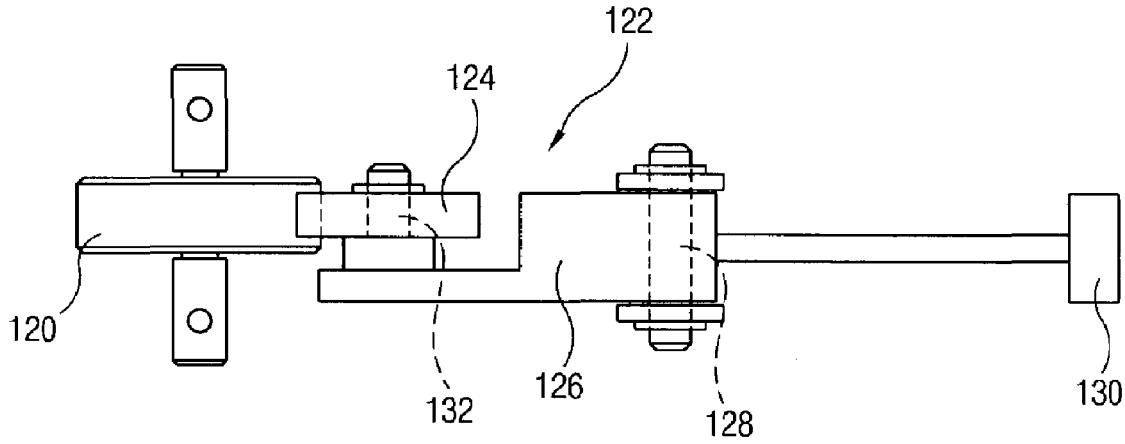
FIG. 2 CONVENTIONAL ART
FIG. 2 is a side view showing a media thickness detecting device according to the conventional art.
Figure 3:
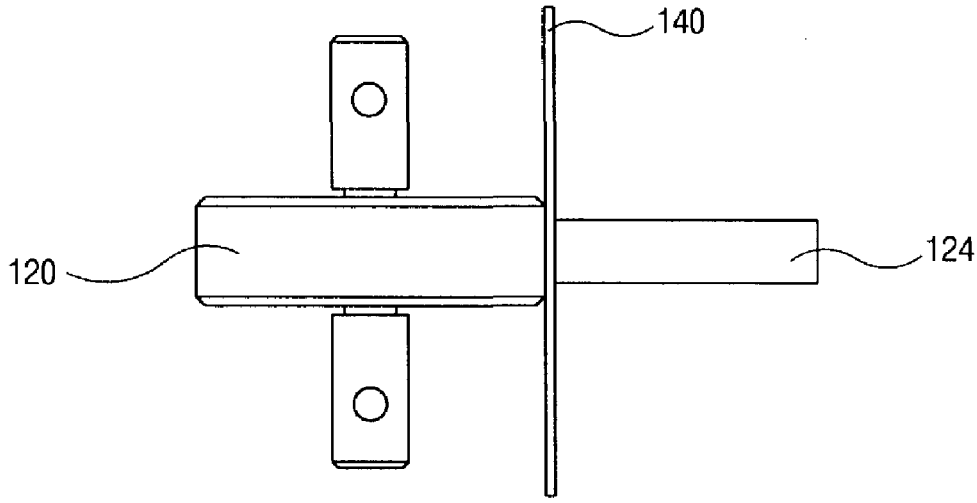
FIG. 3 CONVENTIONAL ART
FIGS. 3 and 4 are views showing usage status of the media thickness detecting device according to the conventional art.
Figure 4:
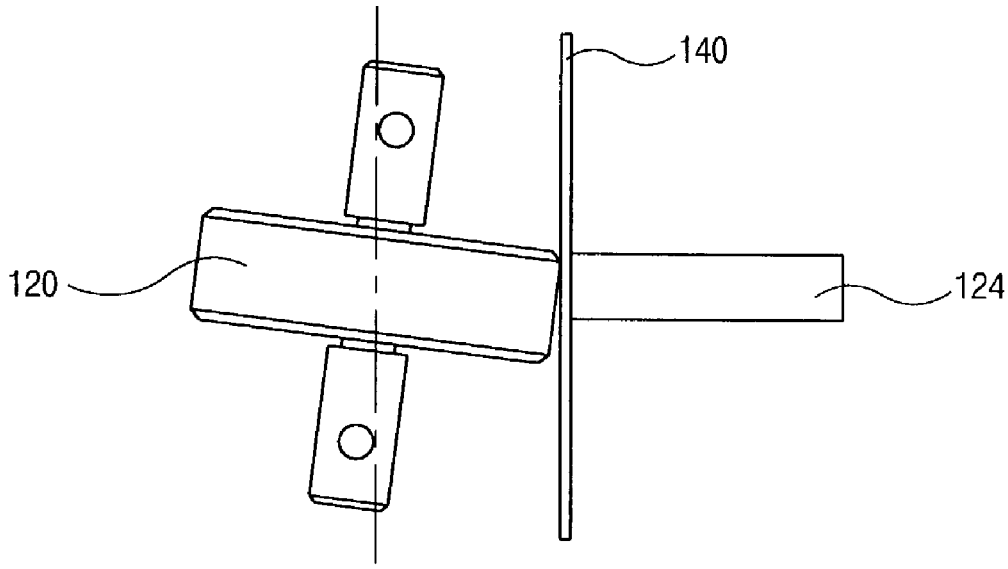
FIG. 4 CONVENTIONAL ART

Referring to FIG. 1, the media dispenser according to the present invention comprises: a base plate 6 receiving a media cassette 2 storing media and a collection chamber 4 for withdrawing inferior media; a media pickup portion 8 installed on a lower part of the base plate 6 and discharging the media stored in the media cassette 2 after dividing the media one by one; a media feeding portion 10 for conveying the media discharged through the media pickup portion 8; and a media discharging portion 12 discharging the media conveyed through the media feeding portion 10 to outer side.

In addition, the media dispenser comprises: a feed sensor 92 installed on one side of the media feeding portion 10 for counting the media by detecting the passage of media; a thickness detecting device 94 for detecting the thickness of the media; an eject sensor 106 sensing the media discharged through the media discharging portion 12; a reject sensor 108 installed on the collection chamber for counting the withdrawn inferior media; and a silt sensor 96 detecting rotating times of a driving motor 24 and a length of the media with the feed sensor 92 to control the operation of the media dispenser.

The media thickness detecting device 94 of the present invention comprises: a feed roller 150 installed on one side of the media feeding portion 10 and contacting to the media 168 which passes through the media feeding portion 10; a thickness sensing portion 152 contacted to a surface of the feed roller 150 by a point and supported to be rotatable; and a thickness measuring portion 154 measuring the thickness of the media by detecting rotating amount of the thickness sensing portion 152.

The thickness sensing portion 152 comprises a contacting portion contacted to the surface of the feed roller 150 by a point and moved as much as the thickness of the media when the media 168 passes through the surface of the feed roller 150; and a rotating arm 158 having the contacting portion 156 installed thereon and one side supported to be rotatable, and then, rotated due to the movement of the contacting portion 156.

Figure 7:
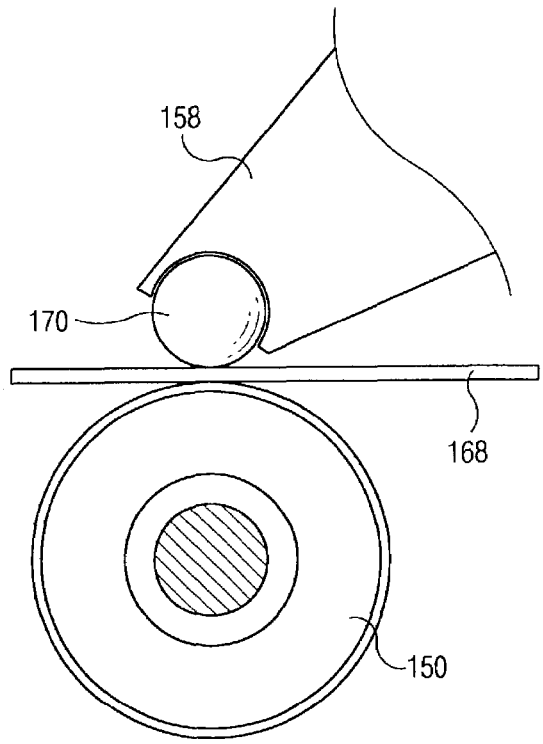
FIG. 7 is a side view showing a media thickness detecting device according to another embodiment of the present invention.

The contacting portion 156 is formed integrally on the end portion of the rotating arm 158 as a hemisphere shape to be contacted to the surface of the feed roller 150 by a point. In addition, as another embodiment, the contacting portion 156 may be formed as a ball shape 170 which is inserted into the end portion of the rotating arm to be rotatable and contacted to the surface of the feed roller by the point as shown in FIG. 7. The contacting portion 156 can be applied as any shape if it can be contacted to the surface of the feed roller 150 by the point.

The contacting portion 156 is formed as a hemisphere or a ball 170 type and contacted to the surface of the feed roller 150, and therefore, the contacted status to the surface of the feed roller 150 can be maintained even if the center axis of the feed roller 150 is changed. Therefore, the thickness of the media can be measured exactly different from the conventional art in which the change of center axis angle is deepened or the distance is changed due to the angle change.

The rotating arm 158 includes a contacting portion 156 which is contacted to the feed roller 150 by the point on one end portion, a thickness measuring portion 154 for measuring the thickness of the media by detecting the rotating amount of the rotating arm 158 on the other end portion, and a hinge shaft 160 supporting the rotating arm 158 to be rotatable on a center portion of the rotating arm 158.

Herein, the hinge shaft 160 is located near the contacting portion 156 to make the rotating arm 158 rotated a lot even if the contacting portion 156 is moved slightly, and thereby, precise thickness measuring can be made in the thickness measuring portion 154.

The thickness measuring portion 154 can be applied as various types which are able to measure the thickness of the media by detecting the rotating amount of the rotating arm 158.

Operations of the media thickness detecting device constructed as above according to the present invention will be described as follows.

The media 168 which is transmitted one by one from the media pickup portion 8 is guided by the media feeding portion 10, and discharged to outer side through the media discharging portion 12.

At that time, the media thickness detecting device 94 detects the thickness of the media 168 which passes through the media feeding portion 10 to identify two overlapped media 168. And if it is decided that a plurality of media are overlapped, the media are withdrawn to the collection chamber 4.

The media 168 passes between the feed roller 150 and the contacting portion 156 contacted to the surface of the feed roller 150, and then, the contacting portion 156 is moved due to the thickness of the media 168. In addition, when the rotating arm 158 connected integrally with the contacting portion 156 is rotated centering around the hinge shaft 160, the thickness measuring portion 154 connected to the end portion of the rotating arm 158 detects the rotating amount of the rotating arm 158 to measure the thickness of the media 168 finally.

In the media thickness detecting device of the media dispenser constructed and operated as above according to the present invention, the contacting portion contacted to the surface of the feed roller is formed as a ball and contacted to the feed roller by the point, and therefore, the contacting status to the surface of the feed roller can be maintained even though the center axis of the feed roller is changed. Therefore, the exact rotating amount of the rotating arm is transmitted to the media thickness measuring portion, and the thickness of the media can be measured precisely.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A media thickness detecting device of a media dispenser, comprising:

a feed roller configured to contact with a surface of the media;

a thickness detecting portion, including:

a contacting portion which is configured to contact a surface of the feed roller at a point, wherein the contacting portion comprises a freely rotatable ball; and a rotating arm having the ball installed in an arcuate receiving portion at one end of the rotating arm and having at least one side end supported to be rotatable, wherein the rotating arm is rotated due to movement of the contacting portion when the media passes between the feed roller and the ball; and a thickness measuring portion configured to measure a thickness of the media by detecting a rotating amount of the thickness detecting portion.

2. The device of claim 1, wherein the rotating arm has the one end on which the contacting portion is installed and another end to which the thickness measuring portion is connected, and is rotatably supported by a hinge shaft.

3. A media dispenser, comprising:

a base plate configured to receive a media cassette in which media is stored and a collection chamber in which withdrawn inferior media is stored;

a media pickup portion installed on a lower part of the base plate configured to discharge the media stored in the media cassette after dividing the media one by one;

a media feeding portion configured to convey the media discharged through the media pickup portion; and a thickness detecting device installed on one side of the media feeding portion configured to detect a thickness of the media, wherein the thickness detection device comprises a freely rotatable ball mounted in an arcuate shaped end of a rotatable arm, wherein the rotating arm is rotated due to movement of the contacting portion when the media passes between the feed roller and the ball, and wherein the ball contacts a surface of the feed roller at a point through which the media passes.

4. The dispenser of claim 3, wherein the thickness detecting device further comprises a thickness measuring portion installed on another end portion of the rotating arm configured to measure a thickness of the media by detecting the rotating amount of the rotating arm.

5. The dispenser of claim 4, wherein the rotating arm has the one end on which the contacting portion is installed and the other end to which the thickness measuring portion is rotatably connected, and is supported by a hinge shaft.

* * * * *